United States Patent [19]

Satomura et al.

[11] Patent Number: 4,751,213

[45] Date of Patent: Jun. 14, 1988

[54] RECORDING MATERIAL

[75] Inventors: Masato Satomura, Kanagawa; Akira Igarashi, Shizuoka, both of Japan

[73] Assignee: Fuji Photo Film Co., Ltd., Kanagawa, Japan

[21] Appl. No.: 872,785

[22] Filed: Jun. 10, 1986

[30] Foreign Application Priority Data

Jun. 10, 1985 [JP] Japan ..... 60-125777

[51] Int. Cl.[4] ..... B41M 5/16; B41M 5/18; B41M 5/22

[52] U.S. Cl. ..... 503/218; 427/150; 427/151; 503/217; 503/221; 503/225

[58] Field of Search ..... 346/200, 217, 218, 225; 427/150–152; 503/200, 217, 218, 221, 225

[56] References Cited

U.S. PATENT DOCUMENTS 4,632,899 12/1986 Takeda ..... 430/292

*Primary Examiner*—Bruce H. Hess

*Attorney, Agent, or Firm*—Sughrue, Mion, Zinn, Macpeak, and Seas

[57] ABSTRACT

A recording material comprising a support having thereon a layer comprising a polymer of an electron-donating color former and an electron-accepting compound which is capable of forming color upon contact with said electron-donating color former. The recording material is useful in duplication by pressure-sensitive or heat-sensitive recording.

1 Claim, No Drawings

RECORDING MATERIAL

FIELD OF THE INVENTION

The present invention relates to a recording material and, more particularly, one which employs a polymer of an electron-donating color former. The recording material is useful in duplication by pressure-sensitive or heat-sensitive recording.

BACKGROUND OF THE INVENTION

A variety of compounds have been investigated with respect to their usefulness as electron-donating color formers that would form color upon contact with electron-accepting compounds, and among the compounds which have been extensively studied are triphenylmethane phthalide compounds, fluoran compounds, phenothiazine compounds, indolylphthalide compounds, leucoauramine compounds, rhodamine lactam compounds, triphenylmethane compounds and triazene compounds. Such compounds may be employed in various recording systems such as pressure-sensitive, heat-sensitive, and current impressed heat-sensitive recording systems. The performance of recording materials depends largely upon the characteristics of the color formers, such as their water solubility, oleophilicity and hydrophobicity. Attempts have been made to introduce oleophilic groups into the color formers or convert them into bis forms with a view to increasing their oleophilicity to such an extent that they can be dissolved in oils in higher concentrations or in order to minimize the occurence of fogging as described, for example, in Japanese Patent Application No. 64036/83 (corresponding to U.S. Patent Application Ser. No. 599,361 filed on Apr. 12, 1984). However, the color formers into which oleophilic groups have been introduced have increased molecular weights and they produce a reduced color density for the unit weight. Color formers in the bis form are also disadvantageous in that they are difficult to manufacture and in that considerable difficulties are encountered in obtaining and purifying the starting materials.

The present inventors have heretofore made concerted efforts to solve these problems of the prior art techniques and, as a result, have come to realize that such problems can be solved by converting color formers into high molecular weight compounds. The present invention has been accomplished on the basis of this finding.

SUMMARY OF THE INVENTION

The primary object, therefore, of the present invention is to provide a recording material that makes effective use of a polymer of a color former.

This and other objects are achieved by providing a recording material comprising a support having thereon a layer comprising a polymer of an electron-donating color former and an electron-accepting compound which is capable of forming color upon contact with said electron-donating color former.

DETAILED DESCRIPTION OF THE INVENTION

The polymer of an electron-donating color former used in the present invention is prepared by homo- or copolymerizing a color former having a vinyl group. If a copolymer of such a color former is used to prepare the polymer, the proportion of the color former is desirably not less than 20 mol % in order to provide a recording material having good properties.

Polymerization reactions may be carried out by cation polymerization, anion polymerization or radical polymerization with satisfactory results. An emulsion polymerization reaction performed for preparing a copolymer of the color former may advantageously be carried out by radical polymerization.

As previously proposed by the present inventors, the color former having a vinyl group may be synthesized by reacting a color former having at least one active hydrogen atom such as in the form of —OH or $$-\overset{|}{N}H$$

with a compound such as an acid halide, ester, halide or isocyanate having a vinyl group and an active group. Illustrative vinyl groups include vinyl, vinylidene, haloethyl, acryl, methacryl and allyl groups. Illustrative active groups are those which are capable of forming covalent bonds upon addition or condensation reactions with an active hydrogen or groups having an active hydrogen. More specific examples of active groups are listed below: —COCl, —NCO,

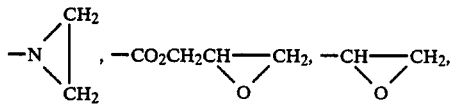

—$CH_2Cl$, —CHO, —$SO_2Cl$, —$CH_2COCl$, —$COCH_2Br$, —$OCH_2COCl$, —$COCH_3$, —$CO_2H$, —Br, —I, —$SO_2CH{=}CH_2$, —$SO_2CH_2CH_2Cl$, etc. From the viewpoints of reactivity and handling properties, —COCl, —$CH_2Cl$ and —$SO_2Cl$ are preferred. The reaction is advantageously performed in the presence of organic or inorganic acid or base catalysts. It is particularly desirable that the reaction is performed in a polar solvent.

Illustrative examples of the compounds having a vinyl group and an active group are listed below:

(1) Vinylbenzoic acid chloride,
(2) Vinylphenyl isocyanate,
(3) Vinylbenzoic acid glycidyl ester,
(4) Divinylbenzenemonoepoxide,
(5) Vinylphenolglycidyl ether,
(6) Vinylbenzyl chloride,
(7) Formylstyrene,
(8) p-Styrenesulfonyl chloride,
(9) Bromoethylbenzenesulfonyl chloride,
(10) Vinylphenylacetic acid chloride,
(11) Vinylphenoxyacetyl chloride,
(12) Vinylacetophenone,
(13) Vinyl-α-bromoacetophenone,
(14) Vinylphenylvinylsulfone,
(15) Bromostyrene,
(16) Bromoethylbenzoic acid chloride,
(17) Acrylic acid chloride,
(18) Methacrylic acid chloride,
(19) Acrylic acid glycidyl ether,
(20) Methacrylic acid glycidyl ether,
(21) p-Acrylaminophenylglycidyl ether,
(22) Sorbic acid chloride, and
(23) Methylolacrylamide, etc.

The color former having an active hydrogen atom desirably has $$-\overset{|}{N}H$$

in a partial skeleton. It will, therefore, be understood that an example of the most preferable compound useful in the present invention is the color former having a vinyl group which is prepared by reacting a color former having at least one $$-\overset{|}{N}H$$

with a compound having a vinyl group and an active group. A variety of compounds are known as such most preferable color formers, and they include triphenylmethane phthalide compounds, fluoran compounds, phenothiazine compounds, indolylphthalide compounds, leucoauramine compounds, rhodamine lactam compounds, triphenylmethane compounds and triazene compounds.

More specific examples of the compounds which serve as color formers having at least one active hydrogen atom are listed below:

(1) 2-Amino-6-diethylaminofluoran,
(2) 2-Amino-3-methyl-6-dibutylaminofluoran,
(3) 2-Amino-3-pentadecyl-6-N-ethyl-N-isoamylaminofluoran,
(4) 2-Amino-3-methyl-6-dibutylaminofluoran,
(5) 2-Ethylamino-3-methyl-6-dibutylaminofluoran,
(6) 2-β-Hydroxyethylamino-6-diethylaminofluoran,
(7) 2-Anilino-3-methyl-6-ethylaminofluoran,
(8) 2-Anilino-3-methyl-6-N-methyl-N-β-aminoethylaminofluoran,
(9) 2-p-Aminoanilino-3-methyl-6-diethylaminofluoran,
(10) 2-Hydroxy-4-diethylaminophenyl-2'-hydroxy-4'-methyl-5'-anilinophenyl phthalide,
(11) Michler's hydrol,
(12) 4-Diethylaminophenyl-4'-ethylaminophenyl phthalide,
(13) 3-(2'-Acetoxy-4'-ethylaminophenyl)-3-(1''-n-octyl-2''-methylindol-3''-yl) phthalide, and
(14) N-Ethylaminobenzoyl leucomethylene blue.

Examples of the color formers having a vinyl group which may be used in the present invention are listed below:

(1) 2-Acrylamido-6-diethylaminofluoran,
(2) 2-Acrylamino-6-dibutylaminofluoran,
(3) 2-Acrylamino-6-N-cyclohexyl-N-methylaminofluoran,
(4) 2-Acrylamino-3-chloro-6-diethylaminofluoran,
(5) 2-Acrylamino-3-methyl-6-diethylaminofluoran,
(6) 2-Methacrylamino-3-ethyl-6-dibutylaminofluoran,
(7) 2-p-Methacrylaminoanilino-6-diethylaminofluoran,
(8) 2-p-Acrylaminoanilino-6-dibutylaminofluoran,
(9) 2-β-Acrylaminoethylamino-6-dibutylaminofluoran,
(10) 2-β-Acrylaminopropylamino-3-chloro-6-diethylaminofluoran,
(11) 2-Anilino-3-β-acrylaminoethyl-6-diethylaminofluoran,
(12) 2-p-Chloroanilino-3-β-methacrylaminopropyl-6-dibutylaminofluoran,
(13) 2-Anilino-3-methyl-6-N-p-acrylaminoanilino-N-ethylaminofluoran,
(14) 2-Dibenzylamino-6-N-acrylamino-N-ethylfluoran,
(15) 2-Hexylamino-6-N-methacrylamino-N-methylfluoran,
(16) 2-p-Vinylbenzoylamino-6-diethylaminofluoran,
(17) 2-p-(4'-Vinylbenzoylamino)anilino-3-methyl-6-dibutylaminofluoran,
(18) 2-p-(4'-Vinylbenzylamino)anilino-3-chloro-6-N-ethyl-N-isoamylaminofluoran,
(19) 2-Vinylbenzylideneamino-6-diethylaminofluoran,
(20) 2-β-(p-Vinylbenzoylamino)ethylamino-3-chloro-6-diethylaminofluoran,
(21) 2-β-(p-Vinylbenzoylaminoethylamino)ethylamino-6-diethylaminofluoran,
(22) 2-p-Vinylbenzenesulfonylamino-3-isoamyl-6-diethylaminofluoran,
(23) 2-Anilino-3-methyl-6-N-ethyl-N-β-p-vinylbenzoylaminoethylaminofluoran,
(24) (p-Vinylbenzoylamino)benzoyl leucomethylene blue,
(25) 4-Diethylaminophenyl-4'-N-ethyl-N-vinylbenzylaminophenyl phthalide,
(26) 2-p-Vinylbenzoyloxy-4-diethylaminophenyl-2'-p-vinylbenzoyloxy-4'-methyl-5'-anilinophenyl phthalide,
(27) 2-p-Vinylphenylureido-6-diethylaminofluoran,
(28) 2-p-Vinylanilino-3-methyl-6-diethylaminofluoran,
(29) 2-Anilino-4-γ-p-vinylbenzoylaminobutyl-6-diethylaminofluoran,
(30) 2-β-Hydroxy-γ-p-vinylphenoxypropylamino-6-diethylaminofluoran,
(31) 2-Dibenzylamino-6-N-cyclohexyl-N-p-vinylbenzyl-aminofluoran, and
(32) 2-Anilino-3-methyl-6-N-ethyl-N-vinylbenzylaminofluoran.

Advantageously, the color former having a vinyl group as illustrated above is copolymerized with other vinyl or vinylidene monomers since this allows the particle size, solubility, stickiness, dispersion stability and color forming ability to be freely controlled. In preparing a copolymer, the color forming component which is contacted with an acidic material to form a color is typically incorporated in an amount of at least 5 mol %, preferably at least 20 mol %.

Vinyl or vinylidene monomers that may be copolymerized with the color former having a vinyl group include acrylamide, cellosolve acrylate, styrene, methyl methacrylate, acrylonitrile, vinylcarbazole, octyl acrylate, sodium acrylamidopropanesulfonate, butyl methacrylate, ethyl acrylate, divinylbenzene, vinyldioxolane, epichlorohydrin, allyl methacrylate, cinnamoyloxyethyl methacrylate, vinylbenzophenone, ethylene glycol diacrylate, diethylene glycol diacrylate, acryloylmorpholine, hydroxyethyl methacrylate, p-vinylbenzenesulfonylazide, and o-quinoneazide acrylate.

As mentioned earlier in this specification, the polymerization reaction may be carried out by various techniques such as radical polymerization, ion polymerization, solution polymerization, emulsion polymerization, suspension polymerization and solventless polymerization.

Radical polymerization may be started by a radical initiator. Additives may be employed such as persulfate reducing agents, oily or aqueous azo compounds, peroxides, and metallic catalysts. The polymerization reaction is preferably carried out in an inert gas atmosphere, and if the reaction system is heated, the temperature for heating is generally not higher than 120° C., with temperatures not higher than 90° C. being particularly preferable.

Solvents such as polar solvents (e.g., water, esters, ethers, halides, ketones, amides and alcohols) and non-polar solvents (e.g., hydrocarbons and aromatics) may be used either independently or in combination.

The color formers listed before may be incorporated in the polymerization reaction system with a view to providing improved color hues or efficiency of color formation.

Standard procedures for polymerization reactions may advantageously be employed in performing various operations which accompany the polymerization described above, such as emulsification, degassing, control of the reaction temperature, handling of metallic catalysts, treatments subsequent to the completion of the polymerization reaction, and the purification of the resulting large molecular compound. Details of the general operating procedures are shown in Sorensen, *Kobunshi Gosei Jikkenho* (*Experimental Polymer Syntheses*), published by Tokyo Kagaku Dojin, 1966.

In the present invention, an amount of an electron-donating color former is from 0.02 to 5.0 g/m$^2$, preferably from 0.05 to 2.0 g/m$^2$.

Examples of the electron-accepting compounds that may be used in the present invention, which are described, for example, in U.S. Pat. Nos. 3,726,804, 4,069,353 and 4,132,112, include acid clay; phenolic resins; metal salts of alkyl- or aralkyl-substituted salicylic acids; phenolic derivatives which are unsubstituted at either the 2- or 6-position, such as bis(4-hydroxyphenyl)alkane derivatives, bis(3-chloro-4-hydroxyphenyl)alkane derivatives, bis(4-hydroxyphenyl)sulfone derivatives, and (4-hydroxyphenyl)-(4'-alkoxyphenyl)-sulfone derivatives; p-hydroxybenzoic acid ester derivatives, resorcylic acid ester derivatives, orsellinic acid ester derivatives, gallic acid ester derivatives, as well as salicylic acid, alkyl- or aralkyl-substituted derivatives thereof, and zinc salts thereof.

The following compounds may be given as typical examples of the phenolic derivatives:

(1) 2,2-Bis(4-hydroxyphenyl)propane,
(2) 1,1-Bis(4-hydroxyphenyl)hexane,
(3) 1,1-Bis(3-chloro-4-hydroxyphenyl)cyclohexane,
(4) 1,1-Bis(3-chloro-4-hydroxyphenyl)-2-ethylbutane,
(5) Benzyl p-hydroxybenzoate,
(6) Zinc 3,5-di-α-methylbenzylsalicylate,
(7) 4,4'-Dihydroxy-3'-isopropyldiphenylsulfone,
(8) 1,1-Bis(4-hydroxyphenyl)cyclohexane,
(9) Cinnamyl resorcylate ester,
(10) β-Phenethyl orsellinate,
(11) Cinnamyl orsellinate,
(12) β-o-Chlorophenoxyorsellinate,
(13) β-Phenoxyethyl resorcylate,
(14) o-Methylbenzyl resorcylate ester,
(15) 2,4-Dimethylphenoxyethyl resorcylate ester,
(16) β,β'-Bis-4-hydroxyphenylthioethyl ether,
(17) β-Phenoxyethyl resorcylate ester,
(18) Poly-p-vinyloxybenzylhydroquinone,
(19) β,β'-Bis-4-hydroxyphenylthioethyloxymethane, and
(20) Monoisopropyl bisphenol S.

Particularly useful phenolic derivatives are phenolic compounds such as alkylene bisphenols and cycloalkylene bisphenols, as well as phenolic compounds having electron-attracting groups. If the recording material of the present invention is to be used as light-sensitive recording paper, a heat-fusible agent having a melting point range of 70° to 140° C. may be incorporated into the composition in order to provide a markedly increased color forming speed that renders the recording paper adapted to use on a high speed facsimile.

A suitable heat-fusible agent is selected from among the compounds having functional groups (e.g., ethers, esters and amides) and compounds having aromatic rings. Illustrative examples include the following: stearamide, stearic acid anilide, ethylene bisstearamide, benzoin, α-naphtholbenzoate, β-naphthol-p-methyl benzoate, para-t-butylphenolphenoxyacetate, para-phenylphenol-p-chlorophenoxyacetate, 4,4'-cyclohexylidene diphenol diacetate, 4,4'-isopropylidene diphenol dimethyl ether, β-phenylethyl-p-phenylphenol ether, phenyloxynaphthoate ester, ethyl p-methoxycarbonylbenzoate amide, stearylurea, ditolyl carbonate, 1-phenoxy-2-p-tolyloxyethane, 1-p-chlorophenoxy-2-phenoxyethane, and 1-phenoxy-2-p-methyloxyphenoxyethane. Those which are particularly preferable for use in the present invention are ethers, esters and amides having a phenolic hydroxyl group or those having an aromatic ring such as aromatic amine derivatives.

Synthesis methods of electron-accepting compounds which may be used in the present invention are well known in the art as described, for example, in U.S. Pat. Nos. 3,726,804, 4,069,353 and 4,132,112.

In the present invention, an amount of an electron-accepting compound is from 0.05 to 3.5 g/m$^2$, preferably from 0.2 to 1.5 g/m$^2$.

Copolymers having black hue may readily be obtained by incorporating in the reaction system two or more color formers having a vinyl group which form different colors. With respect to a color formation by additive processes, it is well known in the field of color image formation.

The recording material of the present invention may incorporate standard color formers such as crystal violet lactone, benzoyl leucomethylene blue, malachite green lactone, rhodamine B lactam, and 1,3,3-trimethyl-6'-ethyl-8'-butoxyindolinobenzospiropyran. The color formers incorporated in the recording material of the present invention may be microencapsulated by various techniques which are detailed in such prior art references as U.S. Pat. Nos. 2,712,507, 2,730,456, 2,730,457, 3,418,250 and 3,432,327. Solvents are desirably used in microencapsulation and preferable examples of the solvents are phenylalkanes such as 1-phenyl-1-xylylethane, 1-phenyl-1-p-ethylphenylethane and 1,1'-ditolylethane and triphenylmethane; and aliphatic ketones and aliphatic acid ester chlorinated paraffins.

Examples of forming the wall of microcapsules include the method utilizing (i) coacervation of gelatin, etc., (ii) polymer precipitation, and (iii) polymerization of reactants from the inside of oil droplets. In the above methods, particularly good results are obtained with microencapsulation techniques such as (ii) polymer precipitation or (iii) polymerization of reactants from the inside of oil droplets. These techniques enable rapid production of microcapsules which are uniform in size, have dense walls and exhibit good storage quality and which hence are highly suitable for use in recording materials.

Specific examples of the application of these microencapsulation techniques and the compounds produced are described in U.S. Pat. Nos. 3,726,804 and 3,796,669. For details of the polyisocyanates that can be used, and the polyols and polyamines to be reacted therewith, see U.S. Pats. Nos. 3,135,716, 3,281,383, 3,468,922, 3,773,695 and 3,793,268, Japanese Patent Publication Nos. 40347/73 and 24159/74, and Japanese Patent Application (OPI) Nos. 80191/73 and 84086/73 (the term "OPI" as used herein refers to a "published unexamined Japanese patent application"). Microcapsules may be prepared from the compounds listed in these patents.

Supports which are suitable for use with the recording material of the present invention include plastic films, synthetic papers, laminated papers, aluminum plates, paper, neutralized papers and surfacesized papers.

The color former of the present invention and the associated electron-accepting compound may be coated onto supports using binders such as PVA, HEC or latices, and protective agents such as starch particles. Additives for use in recording systems such as binders, antioxidants, anti-smudge agents and surfactants, as well as the methods for coating and using them are well known in the art and are disclosed, for example, in U.S. Pat. Nos. 2,711,375 and 3,625,736, British Pat. No. 1,232,347, Japanese Patent Application (OPI) Nos. 44012/75, 50112/75, 127718/75 and 30615/75, and U.S. Pat. Nos. 3,836,383 and 3,846,331. The techniques described in these patents may be employed in the present invention.

Coating techniques which may be employed in fabricating the recording material of the present invention include air knife coating, blade coating and curtain coating.

The present invention is hereunder described in greater detail with reference to the following examples which are not meant to be limiting. Unless otherwise specified, all ratios, percents, etc., are by weight.

EXAMPLE 1

65 Parts of precipitated calcium carbonate, synthesized, 35 parts of aluminum hydroxide (H-10 of Showa Denko K.K.), a ground mixture of 1.8 parts of styrene-/α-methylstyrene pentamer and 8.2 parts of zinc 3,5-di-α-methylbenzylsalicylate, 10 parts of zinc oxide and 1 part of sodium hexametaphosphate were dispersed in 200 ml of water. The dispersion was treated in a sand mill to provide particles with an average size of 2.6 μm. This dispersion was intimately mixed with 9 parts of polyvinyl alcohol, 20 parts of carboxydenaturated SBR latex (48%) and 110 parts of water.

The resulting coating solution was applied to a base paper (basis weight: 43 g/m$^2$) to form a layer having a coating weight of 5.2 g/m$^2$ (on a dry basis) and the web was dried at 90°C.

An aqueous solution of PVA was then applied to the dried web to form a layer in a thickness of about 1.5 μm and the web was dried.

Metered amounts of 2-acrylamino-6-diethylaminofluoran (1 g), tetrahydrofuran (20 ml) and methyl ethyl ketone (5 ml) were charged into a flask provided with a nitrogen gas introducing pipe and nitrogen gas was bubbled through the mixture in the flask for 15 minutes. Azobisdimethyl isovaleronitrile (15 ml) was added to the mixture which was subsequently held at 60° to 65° C. for 6 hours as nitrogen gas slowly bubbled through. Thereafter, the mixture in the flask was poured into methanol (400 ml). The resulting polymer was dispersed in a 2% aqueous solution of PVA. The coating solution was then applied to the previously prepared coated paper such that the coating weight of the color former was 0.1 g/m$^2$. When the web was heated at 130° C., a bright red color formed.

EXAMPLE 2

A polymer solution was prepared as in Example 1 except that a 1:1 mixture of 2-acrylamino-6-diethylaminofluoran and butyl methacrylate was used and that the reaction time was extended to 8 hours.

When drops of this solution were applied to a synthetic paper (coated with 3 g/m$^2$ of Bisphenol S), a bright color formed. The density of this color increased upon heating.

A tetrahydrofuran/acetone (1/1) solution of the high molecular weight compound prepared in Example 1 was dripped into alcohol and the so purified large molecular compound was found to have an average molecular weight $\overline{Mw}$ of $6.76\times10^4$ by measurement in accordance with the light scattering method.

While the invention has been described in detail and with reference to specific embodiments thereof, it will be apparent to one skilled in the art that various changes and modifications can be made therein without departing from the spirit and scope thereof.

What is claimed is:

1. A recording material comprising a support having thereon a layer comprising a polymer of an electron-donating color former prepared by reacting a color former having at least one $$-\overset{|}{N}H$$

with a compound having a vinyl group and an active group, and an electron-accepting compound which is capable of forming color upon contact with said electron-donating color former.

* * * * *